US006571797B1

(12) United States Patent
Magidson et al.

(10) Patent No.: US 6,571,797 B1
(45) Date of Patent: Jun. 3, 2003

(54) SINGLE STRAP RESPIRATOR MASK WITH HEAD HARNESS

(75) Inventors: Mark Magidson, Culver City, CA (US); K. Crest Turdjian, Los Angeles, CA (US)

(73) Assignee: Moldex-Metric, Inc., Culver City, CA (US)

( * ) Notice: Subject to any disclaimer, the term of this patent is extended or adjusted under 35 U.S.C. 154(b) by 11 days.

(21) Appl. No.: 09/907,101

(22) Filed: Jul. 16, 2001

(51) Int. Cl.[7] ..... A62B 7/10
(52) U.S. Cl. ..... 128/205.27
(58) Field of Search ..... 128/205.24, 207.13, 128/207.11, 206.24; 2/421

(56) References Cited

U.S. PATENT DOCUMENTS 4,960,121 A * 10/1990 Nelson et al. ..... 128/206.24
5,429,126 A * 7/1995 Bracken ..... 128/207.11
5,946,735 A * 9/1999 Bayes ..... 2/421
6,019,101 A * 2/2000 Cotner et al. ..... 128/207.13

* cited by examiner

*Primary Examiner*—Henry Bennett
(74) *Attorney, Agent, or Firm*—Charles H. Schwartz

(57) ABSTRACT

A single strap respirator mask with a head harness, including a respirator mask, which has a cup shape to fit over the face of a user. The mask includes a pair of ear portions located at and extending from opposite sites of the mask and each ear portion tapers in width from an inside position to an outside end as it extends from the mask. A single strap extends around the head of a user and is attached to the outside end of each ear portion. A head harness is attached to the single strap and lies against the back of the head of a user. The head harness has a width substantially larger than the width of the strap to broaden the support of the strap against the back of the head of a user.

33 Claims, 2 Drawing Sheets

(a)
(b)
(c)
(d)
(e)

SINGLE STRAP RESPIRATOR MASK WITH HEAD HARNESS

THE BACKGROUND OF THE INVENTION

Field of the Invention

The present invention relates to a respirator mask and more specifically to a respirator mask that has a single strap with a head harness.

The purpose of the present invention is to provide an improved respirator mask, which provides for an improved method of use for face respirator users. The benefits of the present invention are an improved ease of use of the mask as well as improved safety for the user.

Traditionally, respirators, including disposable respirators, utilize two straps to secure the mask to the user's face. Both the donning and removal of a mask with two straps is cumbersome and can be uncomfortable, but is an accepted part of the difficulty in wearing a respirator. In addition, occasionally users will not bother to use the second strap resulting in the misuse of the respirator and possibly subjecting the user to reduced protection from a respirator that is designed to fit properly with two straps. To reduce the strap arrangement to a single strap would make the wearing of a respirator significantly easier, and also eliminate the potential for misuse.

SUMMARY OF THE INVENTION

It is generally acknowledged that the pressure that is applied by straps to hold the respirator against the face provides a better fit if that pressure is distributed over a wider area. The current invention accomplishes this with a single strap by providing a novel, pressure distributing elastic portion that is integrally molded into the mask. The strap is attached to this elastic portion. A series of ridges are molded into the thermoplastic edge of the respirator by heat, pressure and cooling in order to create the portion that has the practical effect of a piece of elastic. The elastic portion, which is generally triangular in configuration (due to its purpose of transmitting a narrow force to a wider one,) can be stretched with tension and can then return to its original shape.

The use of a single strap for the respirator creates a practical problem because of the tendency for the strap to not sit stably on the crown of the head. There is a tendency for it to either slip off the top of the head or slip down to the back of the neck. This is generally not a problem with masks having two straps. In order to remedy this problem the present invention uses a head harness that is integrated into the strap system to effectively broaden the support from a relatively narrow element to one that is several inches across. As a specific example, a width of approximately 2 to 3 inches or more for the harness has been found to be appropriate. The harness may be attached to the strap by injection molding a plastic harness directly around the elastic strap by proper molding techniques. The strap may be adjustable using the harness as a frictional member.

A clearer understanding of the invention will be had with reference to the following description and drawings wherein

DETAILED DESCRIPTION OF THE INVENTION

Figures 1, 2, 3, 4, 5, 6:
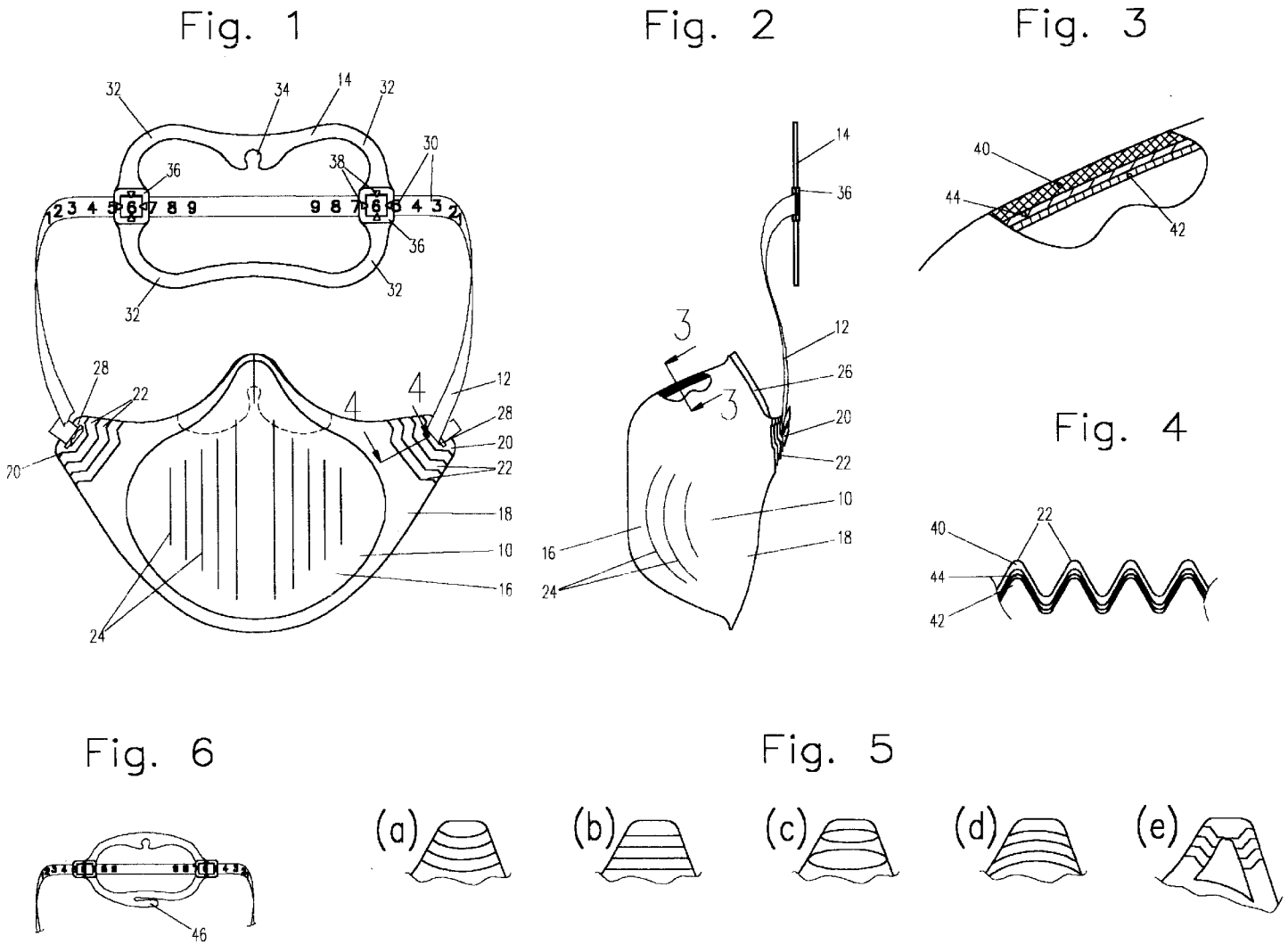
FIG. 1 is a front view of a respirator mask of the present invention incorporating a single strap and head harness.
FIG. 2 is a side view of the respirator mask of FIG. 1.
FIG. 3 is an enlarged cross-sectional view taken along lines 3—3 of FIG. 2.
FIG. 4 is an enlarged cross-sectional view taken along lines 4—4 of FIG. 1.
FIGS. 5(*a*), (*b*), (*c*), (*d*) and (*e*) are alternative designs of the triangular portion of the mask of FIG. 1.
FIG. 6 is an alternative design for the head harness of the mask of FIG. 1, and FIGS. 7(*a*) and (*b*) illustrates an apparatus and method for making the single strap with the head harness of the present invention on a continuous basis.

As shown in FIG. 1 a respirator mask with a single strap and head harness includes a respirator mask 10, a single strap 12 and a head harness 14. These elements are also shown in side view in FIG. 2. The respirator mask 10 includes a central area 16 and a flange area 18 leading to a pair of triangular ear portions 20 on either side of the mask. The triangular ear portions 20 includes a plurality of corrugated ridges 22 which vary in length depending upon the portion of the triangular area in which they are located.

The respirator mask and specifically the central area 16 also includes a plurality of ridges 24 which are used for stability and to give the mask a more rigid shape for support on the face of the user. Also, as shown dotted line in FIG. 1 and in solid line in FIG. 2, a pair of nose flanges 26 may be used to help support the face mask on the face of the user and to provide for sealing along the side of the nose when the face mask is positioned on the face of the user.

The single strap 12 is a continuous elastic member, which is attached to the triangular portions 20 of the facemask using staples 28. It is to be appreciated that other means of attachment may be used, but stapling is a simple and efficient method of attaching the strap. The single strap may also include printed indicia 30 such as numbers 1 to 9 printed at a position where the single strap passes through the head harness 14. The head harness 14 may be generally of a rounded square shape so as to have four corners 32 positioned far enough apart so as to provide for stability on the back of the head of the wearer. The head harness can be made of hi-density polyethylene or any number of suitable flexible polymers. In addition as shown in FIG. 1, the head harness may include an integral button hanger 34 so when the facemask is not in use it may be clipped to the button of the shirt of the user.

Figure 7:
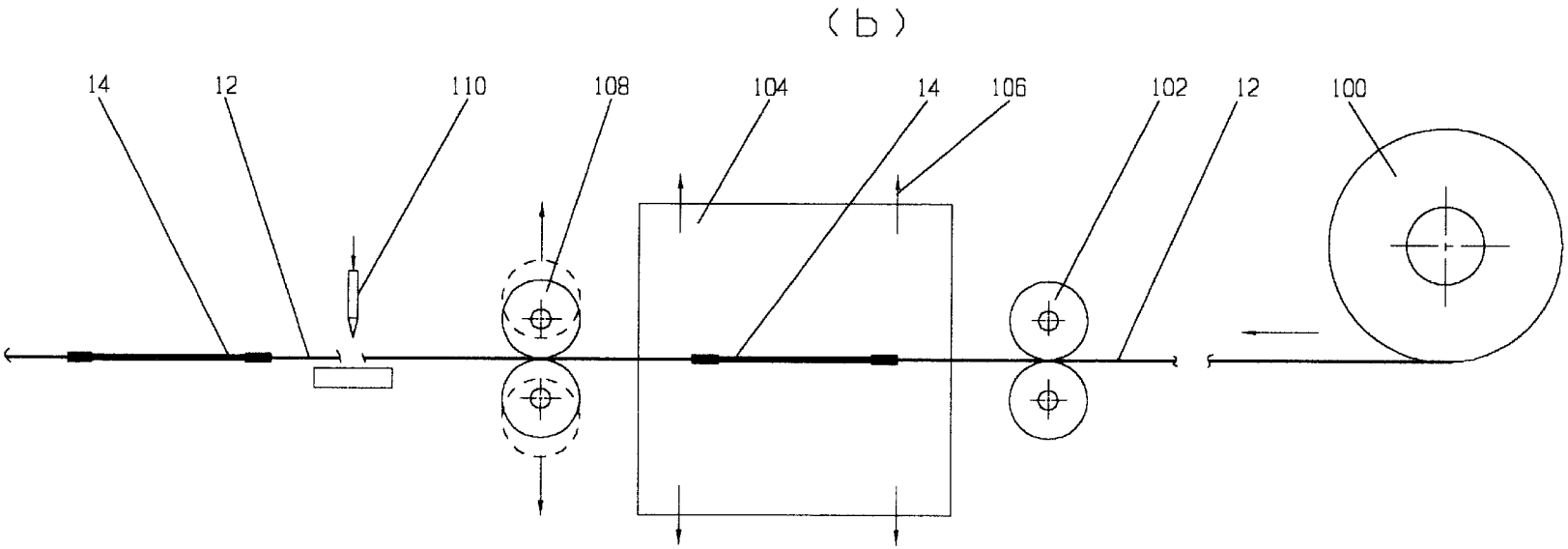
Figure 7:
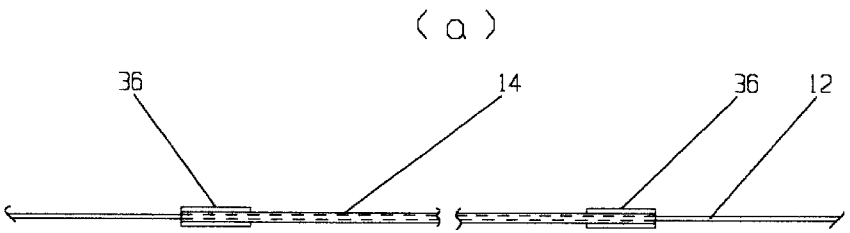

As can be seen in FIGS. 1 and 2, the head harness includes square sections 36 which have an open center and markers 38. The open center of the square sections 36 allows the indicia 30 on the strap 12 to be visible within the squared sections 36 and the markers 38 can help in positioning the strap to the proper length. As shown in FIGS. 2 and 7(*a*), it can be seen that the single strap 12 actually passes through the squared sections 36. The sections 36 are enlarged relative to the remaining portion of the harness and actually captures the strap 12 as it passes through the squared sections 36. As will be explained later, the harness may be molded around the strap 12 to allow for adjustment of the strap to properly position the respirator mask on the face of the user.

FIG. 3 illustrates a cross-section of the mask taken along lines 3—3 of FIG. 2 and is representative of the structure of the mask in the central area 16. As shown in FIG. 3 the mask includes an outer layer of a mesh-like material 40 which serves to support the mask over the nose and mouth area of the user. This mesh-like material is a plastic such as polypropylene. The inner layer 42 is made of a soft material so as to be comfortable against the face of user and may be, for example, a spun-bond polypropylene or other soft material such as a polyester material. The intermediate layer 44 may be any appropriate filter media having specific filtering characteristics dependent upon the use of the respirator mask. For example a very fine melt blown material may be collected to form a filter mask and be used as the intermediate filter layer 44. Other filter media may also incorporates ingredients such as activated charcoal to provide for additional filtering characteristics.

In the flange area 18 of the respirator mask 10 all of the materials forming the central portion 16 are thermally bonded together to form a harder more rigid flange. As shown in FIGS. 1 and 2 ear portions 20 are part of the flange 18 and have a triangular shape. This shape transmits any force provided by the strap 12 at the narrow outer end to a broader and wider force at the wider inner portion of the triangular shape. This configuration therefore transmits the narrow force provided by the single strap 12 to a broader force to help the mask conform more easily to the face of the user.

In addition, as shown in FIG. 4, the triangular area 20 has a series of ridges 22 to provide for tension to again help the mask fit to the face of the user. Specifically as shown in FIG. 4, the various elements including the layers 40, 42 and 44 are all present but they have been compressed and bonded together as with the rest of the flange 18. Therefore, the area 20, as well as the rest of the flange, is thinner in thickness than the same layers as shown in FIG. 3. This can be seen in FIG. 4, which shows the same layers 40, 42 and 44 in a compressed state.

It also is to be appreciated that various configurations may be used other than the specific accordion shape shown in FIG. 1 for the ridges 22 and as an example, FIGS. 5(*a*), (*b*), (*c*), (*d*) and (*e*) illustrate other configuration including curved, rounded, straight and even slotted, but, generally the shape shown in FIG. 1 is to be preferred.

For example, if the ridges are straight and parallel, as shown in FIG. 5(*c*) they can be stretched in one direction under tension but have a lesser ability to recover. It is therefore desireable to design the ridges in the triangular arm in such a way to allow for elasticity so as to return to its original shape with force. The amount of pressure required to extend and contract for this triangular area is dependent on the particular ridge design in combination with the composition of the materials utilized in its construction.

Generally a heavier or harder material will require more tension to extend and will then return to its original shape with more force. Also, the precise sharpness of the ridges and amount of pressure that is applied in the molding process also impact the performance. The amount of linear area that is perpendicular to the pull direction verses the amount of linear area that is parallel to the pull direction also impacts the overall performance. As a specific example it has been found that the use of a combination of polypropylene and EVA thermoplastic at a total weight of between about 200 and 300 grams per square meter is a good range for use in a single-use disposable particulate respirator.

The ridges 22 allows for there to be a variety of angles that the strap can emanate from the mask onto different shaped heads without the mask wrinkling at or near the point of attachment of the strap to the mask body. The specific accordion design shown in FIG. 1 absorbs slight angle variations effectively and spreads the pulling pressure across a much wider section of the mask than the strap itself, which is approximately ¼ to ½ inches in width.

It should be appreciated that the harness itself can be a number of shapes although a preferred shape is shown in FIG. 1. This shape is a rounded square in which the four corners of the harness are spread apart. An alternative oval shape, such as shown in FIG. 6 can be used. The use of the rounded square spreads the force in both length and width and is therefore more stable than if the corners were closer together such as shown in FIG. 6. FIG. 6 however includes another potential advantage of the head harness of the present invention by incorporating a loop 46 which could be used to hang the harness from a belt loop. This is in addition to the button hanger 34 as shown in FIG. 1. It is also to be appreciated that the harness could incorporate both the belt and the button harness in the same design as shown in FIG. 6.

FIGS. 7(*a*) and (*b*) illustrate a side view of the head harness and a method for integrally molding the head harness around the strap. As can be seen in FIG. 7(*a*) the strap 12 passes through the head harness 14 in the rectangular areas 36. Specifically the areas 36 are molded around the strap 12 and can either be permanently locked into position or can be adjustable as shown in FIG. 1 where the strap includes indicia 30 and the rectangular areas 36 include indicia markers 38.

If it is desirable to have the strap permanently locked into position on the head harness this may be accomplished using a method as shown in U.S. Pat. No. 5,970,585. This patent is for a buckle for a respirator mask and is assigned to the same assignee as the present application. In this prior patent, the elastic material is stretched prior to molding a buckle around the strap so as to increase the friction and thereby lock the integrally molded buckle on the strap. A similar method could be used in the present invention if it is desired to have the harness locked onto the strap. Conversely, if it is desired to have the strap adjustable, the strap material should not be stretched prior to molding. This can be seen in FIG. 7(*b*) where a roll 100 of strap material 12 is fed through rollers 102 to have the strap material enter into a mold chamber formed by a pair of mold members 104. The mold members 104 can move into and out of engagement as shown by arrows 106. The mold members 104 have complementary mold recesses to form the head harness 14 when the mold members are in engagement. The strap 12 with integrally molded head harness can then pass through rollers 108 which rollers can pivot to allow the head harness portion to pass through. Finally, a cutter on 110 can cut the strap 12 at a desired location.

In operation, the molding is accomplished using mold members 104 and with the rollers 102 and 108 maintaining the strap material 12 in a relaxed position without any tension. Using this technique it is possible to make the strap adjustable so the strap member will pass through the squared portion 36 of the head harness 14 and be held in frictional yet adjustable engagement.

The harness is molded to the strap and the strap is allowed to be held in the relaxed position and not stretched before the molten plastic is injected. A plastic resin is used that does not overly bond to the strap such as polyethylene or any number of suitable flexible polymers. The strap can slide through the harness's holding elements 36 but still maintain enough friction so the strap can be pulled to a desired position and will hold that position. This is a benefit that previously could not have been attained without the use of costlier and more labor-intensive methods of attaching elements in a more traditional adjustable strap mechanism. It is also possible to print onto the strap the indicia 30 so that a user may be able to choose a comfortable setting and know that this is the best setting for this particular respirator model.

Also as indicated above the injection molded harness can incorporate a variety of shapes that will allow the user to either hang the mask by the harness from a belt loop or button and even used to feed a mask dispenser. This can be incorporated onto the mold design with little or no additional part cost.

Although the invention has been described with reference to particular embodiments it is to be appreciated that various adaptations and modifications may be made and the invention is only to be limited by the appended claims.

What is claimed is:

1. A single strap respirator mask with a head harness, including a respirator mask having a cup shape to fit over the face of a user, the mask including a pair of integral ear portions located at and extending from opposite sites of the mask and with each integral ear portion tapering in width from an inside position to an outside end as it extends integrally from the mask, a single strap for extending around the head of a user and attached to the outside end of each integral ear portion, a head harness attached to the single strap for lying against the back of the head of a user, and the head hardness having a width substantially larger than the width of the strap to broaden the support of the strap against the back of the head of a user.

2. The respirator mask of claim 1 wherein the integral ear portions are generally triangular in shape to provide pressure distribution from the strap to the mask.

3. The respirator mask of claim 1 wherein the integral ear portions are elastic to aid in fitting the mask to the face of a user.

4. The respirator mask of claim 3 wherein the elasticity of the integral ear portions are provided by a plurality of ridges formed in the integral ear portions.

5. The respirator mask of claim 4 wherein the plurality of ridges have an accordion shape.

6. The respirator mask of claim 5 wherein the ear integral portions are generally triangular in shape.

7. The respirator mask of claim 6 wherein the strap is formed of elastic material to aid in securing the mask to the face of a user.

8. The respirator mask of claim 7 wherein the elastic strap is adjustable in length to aid in fitting the mask to the face of a user.

9. The respirator mask of claim 1 wherein the head harness has a generally rounded square shape.

10. The respirator mask of claim 1 wherein the head harness is molded around the strap.

11. The respirator mask of claim 10 wherein the molded head harness provides for frictional engagement with the strap to adjustably secure the strap to the harness for adjustment of the length of the strap.

12. The respirator mask of claim 1 wherein the head harness is molded and includes an integral hanger.

13. The respirator mask of claim 1 wherein the attachment of the head harness to the strap is adjustable and with the strap including indicia to aid in adjusting the length of the strap.

14. The respirator mask of claim 13 wherein the attachment of the head harness to the strap is provided by molding the head harness around the strap to provide frictional adjustable engagement between the head harness and the strap.

15. A respirator mask, including a strap attached to the respirator, including a respirator mask having a cup shape to fit over the face of a user, the mask including a pair of integral ear portions located at and extending from opposite sides of the mask and with each integral ear portion tapering in width from an inside position to an outside end and as it extends integrally from the mask, and a strap for extending around the head of a user and attached to the outside end of each integral ear portion and with the integral tapering ear portions transmitting the force of the strap to broader areas at the inside positions of the integral ear portions.

16. The respirator mask of claim 15 wherein the integral ear portions are elastic to aid in fitting the mask to the face of a user.

17. The respirator mask of claim 17 wherein the elasticity of the integral ear portions are provided by a plurality of ridges formed in the integral ear portions.

18. The respirator mask of claim 17 wherein the elasticity of the ear portions are provided by a plurality of ridges formed in the ear portions.

19. The respirator mask of claim 18 wherein the plurality of ridges have an accordion shape.

20. The respirator mask of claim 19 wherein the integral ear portions are generally triangular in shape.

21. The respirator mask of claim 20 wherein the strap is formed of elastic material to aid in securing the mask to the face of a user.

22. The respirator mask of claim 21 wherein the elastic strap is adjustable in length to aid in fitting the mask to the face of a user.

23. A single strap respirator with a head harness, including a respirator mask having a cup shape to fit over the face of a user, a single strap for extending around the head of a user and attached to the opposite sides of the mask, a head harness attached to the single strap for lying against the back of the head of a user, and the head harness having a width substantially larger than tbe width of the strap to broaden the support of the strap against the back of the head of a user.

24. The respirator mask of claim 23 wherein the head harness has a generally rounded square shape.

25. The respirator mask of claim 23 wherein the head harness is molded around the strap.

26. The respirator mask of claim 25 wherein the molded head harness provides for frictional engagement with the strap to adjustably secure the strap to the harness for adjustment of the length of the strap.

27. The respirator mask of claim 23 wherein the head harness is molded and includes an integral hanger.

28. The respirator mask of claim 23 wherein the attachment of the head harness to the strap is adjustable and with the strap including indicia to aid in adjusting the length of the strap.

29. The respirator mask of claim 28 wherein the attachment of the head harness to the strap is provided by molding the head harness around the strap to provide frictional adjustable engagement between the head harness and the strap.

30. A respirator mask, including a strap attached to the respirator, including a respirator mask having a cup shape to fit over the face of a user, the mask including a pair of ear portions located at and extending from opposite sides of the mask and with each ear portion tapering in width from an inside position to an outside end as it extends from the mask, a strap for extending around the head of a user and attached to the outside end of each ear portion and with the tapering ear portions transmitting the force of the strap to broader areas at the inside positions of the ear portions, and wherein the ear portions are elastic to aid in fitting the mask to the face of a user and with the elasticity of the ear portions provided by a plurality of accordion shape ridges formed in the ear portions.

31. The respirator mask of claim 30 wherein the ear portions are generally triangular in shape.

32. The respirator mask of claim 31 wherein the strap is formed of elastic material to aid in securing the mask to the face of a user.

33. The respirator mask of claim 32 wherein the elastic strap is adjustable in length to aid in fitting the mask to the face of a user.

* * * * *